US006315635B1

(12) United States Patent
Lin

(10) Patent No.: US 6,315,635 B1
(45) Date of Patent: Nov. 13, 2001

(54) METHOD AND APPARATUS FOR SLURRY TEMPERATURE CONTROL IN A POLISHING PROCESS

(75) Inventor: Chih-Lung Lin, Taipei (CN)

(73) Assignee: Taiwan Semiconductor Manufacturing Company, Ltd, Hsin Chu (TW)

( * ) Notice: Subject to any disclaimer, the term of this patent is extended or adjusted under 35 U.S.C. 154(b) by 0 days.

(21) Appl. No.: 09/283,382

(22) Filed: Mar. 31, 1999

(51) Int. Cl.[7] ..... B24B 49/02; B24B 17/00

(52) U.S. Cl. ..... 451/7; 451/5; 451/53; 451/287

(58) Field of Search ..... 451/5, 6, 53, 60, 451/285, 287, 446, 7

(56) References Cited

U.S. PATENT DOCUMENTS 5,196,353 * 3/1993 Sandhu et al. ..... 437/8
5,597,442 * 1/1997 Chen et al. ..... 156/626.1
5,700,180 * 12/1997 Sandhu et al. ..... 451/5
5,775,980 * 7/1998 Sasaki et al. ..... 451/285
5,851,135 * 9/1999 Sandhu et al. ..... 451/5
5,851,846 * 12/1998 Matsui et al. ..... 438/17
5,873,769 * 2/1999 Chiou et al. ..... 451/7
5,957,750 * 9/1999 Brunelli ..... 451/7
6,012,967 * 1/2000 Satake et al. ..... 451/36
6,677,783 * 6/2000 Allman et al. ..... 438/691

* cited by examiner

*Primary Examiner*—Allen Ostrager
*Assistant Examiner*—William Hong
(74) *Attorney, Agent, or Firm*—Tung & Associates

(57) ABSTRACT

A method and an apparatus for controlling slurry temperature in a polishing machine, such as in a chemical mechanical polishing machine, are disclosed. In the method, an ambient temperature slurry is first provided to the surface of a polishing pad, the polishing process is then started with the polishing pad being rotated and intimately engaging a substrate mounted in a polishing head. By using at least two temperature sensors, the temperature of the slurry dispensed and the temperature of the polishing head are determined and sent to a temperature controller which in turn sends a signal to a heater for heating a slurry supply such that the temperature of the slurry being fed is the same as the temperature of the polishing pad. A heated slurry solution at substantially the same temperature of the polishing pad is then fed to the polishing pad for continuing the polishing process. The present invention novel apparatus includes at least two temperature sensors, a temperature controller and a heater or heat exchanger means for increasing the temperature of a slurry solution before it is fed to a polishing process.

20 Claims, 2 Drawing Sheets

METHOD AND APPARATUS FOR SLURRY TEMPERATURE CONTROL IN A POLISHING PROCESS

FIELD OF THE INVENTION

The present invention generally relates to a method and an apparatus for controlling slurry temperature that is used in a polishing process for a semiconductor substrate and more particularly, relates to a method and an apparatus for controlling slurry temperature used in a chemical mechanical polishing process by detecting temperatures of the dispensed slurry and the polishing pad and compensate the temperature difference by heating the slurry supply such that the polishing uniformity across the substrate can be improved.

BACKGROUND OF THE INVENTION

Apparatus for polishing thin, flat semi-conductor wafers is well-known in the art. Such apparatus normally includes a polishing head which carries a membrane for engaging and forcing a semi-conductor wafer against a wetted polishing surface, such as a polishing pad. Either the pad, or the polishing head is rotated and oscillates the wafer over the polishing surface. The polishing head is forced downwardly onto the polishing surface by a pressurized air system or, similar arrangement. The downward force pressing the polishing head against the polishing surface can be adjusted as desired. The polishing head is typically mounted on an elongated pivoting carrier arm, which can move the pressure head between several operative positions. In one operative position, the carrier arm positions a wafer mounted on the pressure head in contact with the polishing pad. In order to remove the wafer from contact with the polishing surface, the carrier arm is first pivoted upwardly to lift the pressure head and wafer from the polishing surface. The carrier arm is then pivoted laterally to move the pressure head and wafer carried by the pressure head to an auxiliary wafer processing station. The auxiliary processing station may include, for example, a station for cleaning the wafer and/or polishing head; a wafer unload station; or, a wafer load station.

More recently, chemical-mechanical polishing (CMP) apparatus has been employed in combination with a pneumatically actuated polishing head. CMP apparatus is used primarily for polishing the front face or device side of a semi-conductor wafer during the fabrication of semi-conductor devices on the wafer. A wafer is "planarized" or smoothed one or more times during a fabrication process in order for the top surface of the wafer to be as flat as possible. A wafer is polished by being placed on a carrier and pressed face down onto a polishing pad covered with a slurry of colloidal silica or alumina in de-ionized water.

A schematic of a typical CMP apparatus is shown in FIGS. 1A and 1B. The apparatus 10 for chemical mechanical polishing consists of a rotating wafer holder 14 that holds the wafer 10, the appropriate slurry 24, and a polishing pad 12 which is normally mounted to a rotating table 26 by adhesive means. The polishing pad 12 is applied to the wafer surface 22 at a specific pressure. The chemical mechanical polishing method can be used to provide a planar surface on dielectric layers, on deep and shallow trenches that are filled with polysilicon or oxide, and on various metal films. CMP polishing results from a combination of chemical and mechanical effects. A possible mechanism for the CMP process involves the formation of a chemically altered layer at the surface of the material being polished. The layer is mechanically removed from the underlying bulk material. An altered layer is then regrown on the surface while the process is repeated again. For instance, in metal polishing a metal oxide may be formed and removed repeatedly.

A polishing pad is typically constructed in two layers overlying a platen with the resilient layer as the outer layer of the pad. The layers are typically made of polyurethane and may include a filler for controlling the dimensional stability of the layers. The polishing pad is usually several times the diameter of a wafer and the wafer is kept off-center on the pad to prevent polishing a non-planar surface onto the wafer. The wafer is also rotated to prevent polishing a taper into the wafer. Although the axis of rotation of the wafer and the axis of rotation of the pad are not collinear, the axes must be parallel. Polishing heads of the type described above used in the CMP process are shown in U.S. Pat. Nos. 4,141,180 to Gill, Jr., et al.; 5,205,082 to Shendon et al; and, 5,643,061 to Jackson, et al. It is known in the art that uniformity in wafer polishing is a function of pressure, velocity and the concentration of chemicals. Edge exclusion is caused, in part, by non-uniform pressure on a wafer. The problem is reduced somewhat through the use of a retaining ring which engages the polishing pad, as shown in the Shendon et al patent.

Referring now to FIG. 1C, wherein an improved CMP head, sometimes referred to as a Titan® head which differs from conventional CMP heads in two major respects is shown. First, the Titan® head employs a compliant wafer carrier and second, it utilizes a mechanical linkage (not shown) to constrain tilting of the head, thereby maintaining planarity relative to a polishing pad 12, which in turn allows the head to achieve more uniform flatness of the wafer during polishing. The wafer 10 has one entire face thereof engaged by a flexible membrane 16, which biases the opposite face of the wafer 10 into face-to-face engagement with the polishing pad 12. The polishing head and/or pad 12 are moved relative to each other, in a motion to effect polishing of the wafer 10. The polishing head includes an outer retaining ring 14 surrounding the membrane 16, which also engages the polishing pad 12 and functions to hold the head in a steady, desired position during the polishing process. As shown in FIG. 1C, both the retaining ring 14 and the membrane 16 are urged downwardly toward the polishing pad 12 by a linear force indicated by the numeral 18 which is effected through a pneumatic system.

In the polishing operation shown in the enlarged cross-sectional view of FIG. 1B, the slurry solution 24 must be forced into an interface between the wafer 10 and the polishing pad 12 in order for the chemical reaction and the mechanical removal process to operate efficiently. The slurry solution 24 (also shown in FIG. 1A) is dispensed from a dispensing nozzle (shown in FIG. 2) onto the polishing pad 12. In most commercial CMP apparatus, the slurry solution 24 is stored in a reservoir and delivered to the dispensing nozzle through a conduit. The slurry solution stored in the reservoir and in the delivering conduit is not provided with a temperature control device. The slurry solution 24 is normally applied to the polishing pad 12 at the same temperature as the chamber temperature in the CMP apparatus, i.e., approximately at room temperature.

During the polishing process, a significant amount of frictional heat is generated between the top surface of the polishing pad and the surface of the substrate that is being polished. The interface formed between the wafer 10 and the polishing pad 12 (shown in FIG. 1B) and the slurry solution 24 trapped therein are therefore heated to a significant higher temperature, i.e., up to 50° C., or between about 40° C. and about 50° C., than the temperature of the slurry solution 24 on the edge of the wafer 10. This creates a serious problem in achieving polishing uniformity across the surface of the wafer 10. The room temperature slurry solution dispensed around the edge of the wafer 10 during the polishing process reduces the temperature of the wafer at the edge portion. This leads to a wafer edge polishing rate drop and a poor polishing uniformity.

It is therefore an object of the present invention to provide a method and apparatus for providing slurry temperature control in a polishing process that is not previously available in conventional polishing machines.

It is another object of the present invention to provide a method for slurry temperature control in a polishing process that can be readily adapted in a chemical mechanical polishing machine.

It is a further object of the present invention to provide a method for slurry temperature control in a chemical mechanical polishing process that allows the slurry to be heated before it is delivered to the polishing surface.

It is another further object of the present invention to provide a method for controlling slurry temperature in a chemical mechanical polishing process in which temperature sensors are utilized to detect the temperature of the dispensed slurry on the surface of the polishing head and the temperature of the polishing pad.

It is still another object of the present invention to provide a method for controlling slurry temperature in a chemical mechanical polishing process that utilizes two temperature sensors, a temperature controller and a heating apparatus.

It is yet another object of the present invention to provide an apparatus for controlling slurry temperature in a chemical mechanical polishing apparatus that can be easily adapted into a conventional CMP machine.

It is still another further object of the present invention to provide a chemical mechanical polishing method by utilizing temperature sensors, a temperature controller and heating devices to provide a heated slurry solution on a surface of the polishing pad for improved polishing uniformity.

It is yet another further object of the present invention to provide an apparatus for controlling slurry temperature in a chemical mechanical polishing machine that includes a polishing disc, a polishing head, motor means for rotating the disc in the polishing head, a slurry dispensing nozzle, a controller for comparing a first temperature of the slurry and a second temperature of the polishing pad, and a heater for heating the slurry to substantially the same temperature of the polishing pad in order to improve the polishing uniformity.

SUMMARY OF THE INVENTION

The present invention provides a method and an apparatus for slurry temperature control in a polishing process such as a chemical mechanical polishing process that provide a heated slurry solution for feeding to a polishing pad and for improving the polishing uniformity.

In a preferred embodiment, a method for controlling slurry temperature in a polishing process can be provided which includes the steps of dispensing a first volume of slurry from a slurry reservoir onto a polishing pad, rotating the polishing pad while intimately engaging against a polishing head, detecting a first temperature of the first volume of slurry, detecting a second temperature of the polishing pad, heating a second volume of slurry to a temperature that is substantially the same as the second temperature of the polishing pad, and dispensing the second volume of slurry onto the polishing pad.

In the method for controlling slurry temperature, the polishing process may be a chemical mechanical polishing process. The first temperature may be between about 20° C. and about 30° C., while the second temperature may be lower than 50° C. The slurry may include $SiO_2$ particles. The method may further include the step of comparing the first temperature to the second temperature in a process controller. The second volume of slurry may be dispensed from a slurry reservoir. The polishing head may carry a semiconductor wafer which has a top surface to be polished that is in intimate engagement with the polishing pad. The method may further include the step of heating the second volume of slurry in a conduit by a heater mounted on the conduit. The method may further include the step of heating the second volume of slurry in a slurry transport pipe by a heat exchanger mounted on the pipe. The heated second volume of slurry when dispensed onto the polishing pad improves the polishing uniformity on a wafer surface.

In an alternate embodiment, a method for chemical mechanical polishing a substrate may be carried out by the operating steps of mounting a substrate on a polishing head with a surface to be polished exposed, engaging the surface to be polished with a surface of a polishing pad forming an interface, the surface to be polished and the polishing pad rotate in opposite directions, dispensing a first volume of slurry at the interface, the first volume of slurry is transported form a slurry reservoir and is kept at a first temperature, detecting a second temperature of the polishing pad, heating a second volume of slurry to substantially the second temperature, and dispensing the second volume of slurry at the interface.

In the method for chemical mechanical polishing a substrate, the first temperature may be under 30° C. and the second temperature may be over 30° C. The step of determining a temperature difference between the first and the second temperature may be executed in a controller. The method may further include the step of heating the second volume of slurry in a conduit for transporting the second volume of slurry by a heater mounted on the conduit. The method may further include the step of mounting a silicon wafer on the polishing pad to expose a top surface to be polished.

The present invention is further directed to an apparatus for slurry temperature control in a polishing machine that includes a polishing disc equipped with a polishing pad on a top surface and a second temperature sensor embedded juxtaposed to the top surface for detecting a second temperature, a polishing head for holding a substrate to be polished therein with a top surface of the substrate exposed, motor means for rotating the polishing disc and the polishing head in opposite directions, a slurry dispensing nozzle for dispensing a first volume of slurry on the polishing pad, the nozzle is equipped with a first temperature sensor for sensing a first temperature of the first volume of slurry, a controller for comparing the first temperature to the second temperature, and a heater for heating a second volume of slurry to the second temperature for dispensing on the top surface of the substrate through the slurry dispensing nozzle.

In the apparatus for slurry temperature control for use in a polishing machine, the polishing machine may be a chemical mechanical polishing apparatus. The apparatus may further include a slurry reservoir means for storing the second volume of slurry. The first temperature may be less than 30° C. and the second temperature may be more than 30° C. The substrate may be a silicon wafer.

BRIEF DESCRIPTION OF THE DRAWINGS

These and other objects, features and advantages of the present invention will become apparent from the following detailed description and the appended drawings in which.

DETAILED DESCRIPTION OF THE PREFERRED EMBODIMENT

The present invention discloses a method for controlling slurry temperature in a polishing process, such as a chemical mechanical polishing process. The present invention further discloses an apparatus for controlling slurry temperature in a polishing machine such as a chemical mechanical polishing machine.

In the method, a temperature of the dispensed slurry and a temperature of the polishing pad during a polishing operation are first detected. The temperatures are then compared in a controller to determine a temperature differential. A heater which is mounted on a slurry delivery conduit is then activated to heat the dispensed slurry to the same temperature as the polishing pad. The present invention novel method is effective in preventing cold slurry solution from being fed to the edge of a wafer that is being polished on a polishing pad. The heated slurry solution dispensed on the polishing pad significantly improves the polishing rate, specifically, around the edge of the wafer. The uniformity problem frequently incurred in a conventional polishing process wherein the edge portion of a wafer is polished at a slower rate than the center portion of the wafer due to the presence of cold slurry can be largely avoided.

The present invention novel apparatus consists mainly of at least two temperature sensors, one sensor mounted to the spray nozzle opening for sensing the temperature of the slurry solution dispensed; while the other temperature sensor is mounted in the polishing disc onto which a polishing pad is mounted for sensing the temperature of the polishing disc during a polishing operation. The present invention novel apparatus further includes a process controller for comparing the temperatures read from the two temperature sensors and outputting a signal to a heater means such as a band heater that is wrapped around a conduit for delivering the slurry solution to the spray nozzle. The heating means may further include means for heating a slurry solution reservoir wherein the bulk slurry solution is stored.

Figure 1A:
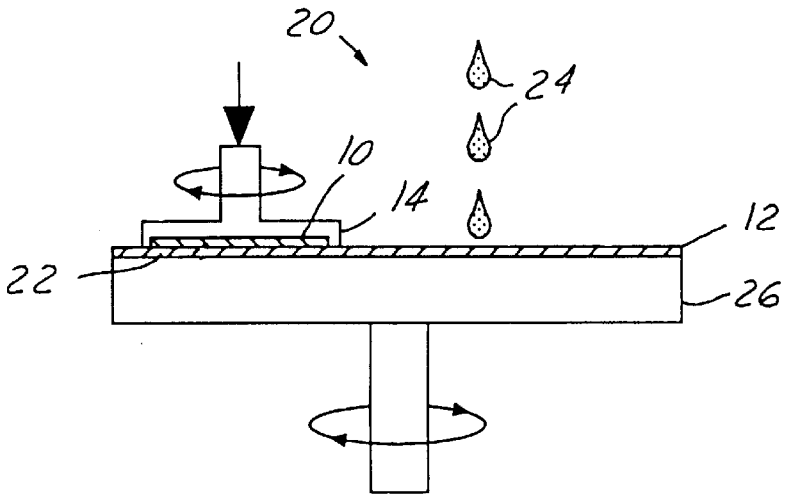
(PRIOR ART) FIG. 1A
FIG. 1A is a cross-sectional view of a conventional chemical mechanical polishing apparatus.
Figure 1B:
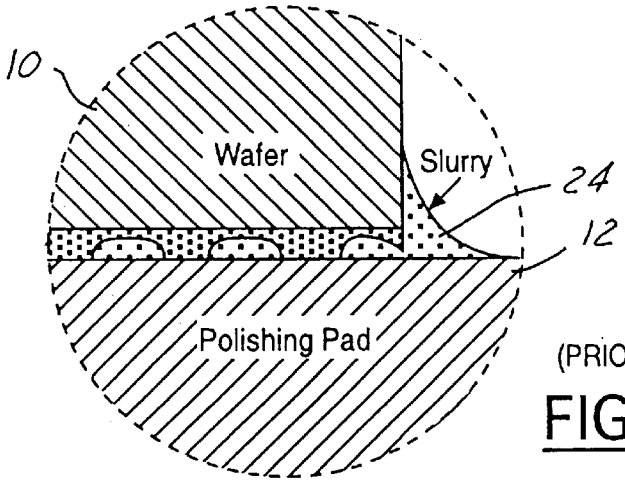
(PRIOR ART) FIG. 1B
FIG. 1B is a partial, enlarged cross-sectional view taken from FIG. 1A illustrating an interaction of slurry solution between the wafer and the polishing pad
Figure 1C:
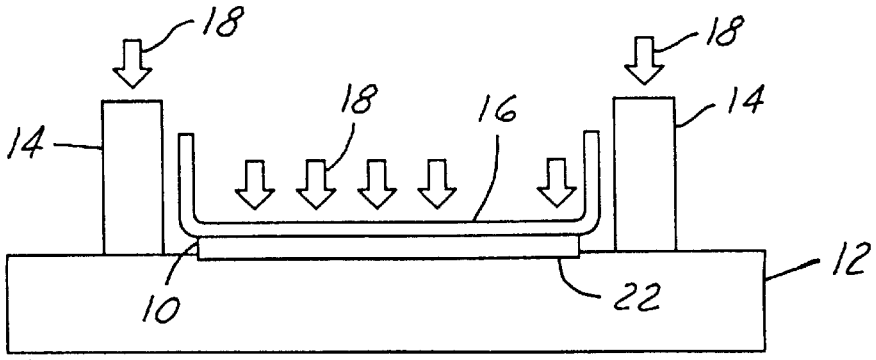
(PRIOR ART) FIG. 1C
FIG. 1C is a cross-sectional view of an improved polishing head utilizing a membrane pressurizing device.
Figure 2:
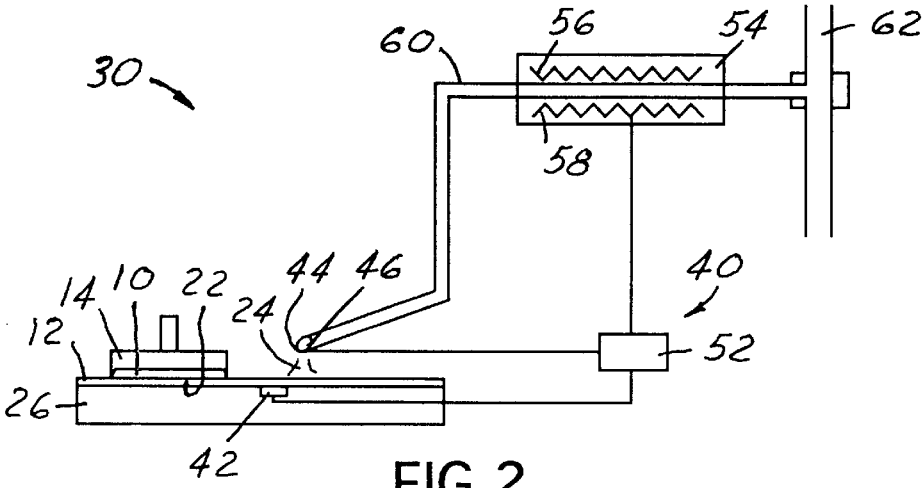
FIG. 2 is an illustrating showing the present invention apparatus for providing slurry temperature control in a chemical mechanical polishing apparatus.

Referring now to FIG. 2 wherein an illustration of a present invention chemical mechanical polishing apparatus 30 incorporating the present invention slurry temperature control apparatus 40 is shown. The chemical mechanical polishing apparatus 30 is similar to that shown in FIG. 1A, consisting essentially of a polishing table (or polishing disc) 26, a polishing pad 12 mounted on the polishing table 26, and a polishing head 14 which holds a wafer 10 to be polished with a top surface 22 in intimate contact with the surface of the polishing pad 12.

The present invention slurry temperature control apparatus 40 consists essentially of two temperature sensors, i.e., a first temperature sensor 42 which is mounted in the polishing table 26 and a second temperature sensor 44 which is mounted at the opening of slurry dispensing nozzle 46. The first temperature sensor 42 is mounted at the surface of the polishing table 26 such that it monitors closely the temperature of the polishing pad 12, i.e., the higher temperature caused by the frictional heat produced between the polishing pad 12 and the wafer 10. It has been found that at the center region of the wafer 10, the temperature can increase by the frictional heat to up to 50° C., and possibly to a temperature in the range between about 30° C. and about 50° C. This is significantly higher than the temperature of the unheated slurry solution 24 which is at the ambient temperature of the CMP apparatus, i.e., at or near room temperature. The first temperature sensor 42 can effectively detect the temperature of the polishing pad 12 since the polishing pad 12 normally has a thickness of approximately 0.5 cm when compared to a much larger thickness of the polishing table 26 of approximately 7~10 cm.

The present invention slurry temperature control apparatus 40 further includes a temperature controller 52 and a heater (or heat exchanger) 54. As shown in FIG. 2, the temperature controller 52 can be provided in any one of a variety of process controllers or process control microprocessors. The heater or the heat exchanger 54, as shown in FIG. 2, can be of the infrared type wherein an upper bank of infrared lamps 56 and a lower bank of infrared lamps 58 are utilized to provide heat to the conduit 60 which is used to transport a slurry solution 24 from a main slurry supply pipe 62 to the slurry spray nozzle 46. It should be noted that instead of the infrared heater 54 shown in FIG. 2, any other suitable types of heating devices may also be utilized to produce the present invention desirable results. For instance, a resistance type heating tape can be used to wrap around the conduit 60 for heating the slurry solution 24 transported therein. The heater 54 is used to supply heat to the slurry solution 24 such that the temperature of the slurry solution 24 dispensed onto the surface of the polishing pad 12 is the same as the temperature of the polishing pad 12 which is detected by the temperature sensor 42. This is shown in FIG. 2.

The present invention novel method for slurry temperature control can be carried out by the following process steps. First, a cold slurry, i.e., a slurry that is kept at ambient temperature from the main slurry pipe or from a slurry reservoir (not shown) is fed through conduit 60 to be dispensed by the dispense nozzle 46. The polishing head 14 then starts to rotate with the polishing table 26 rotating simultaneously in an opposite direction. Frictional heat is generated between the wafer surface 22 and the polishing pad 12 to increase the temperature detected by the sensor 42 of the polishing pad 12. In the next step of the process, the temperature sensors 42, 44 detect different temperatures and the difference is determined by the temperature controller 52 as $\Delta T$ between the dispensed slurry 24 and the polishing pad 12. The temperature controller 52, after determining $\Delta T$, sends out a signal to the heater 54 to heat up the slurry contained in the conduit 60 to compensate for the temperature difference $\Delta T$. A thermal steady state is then kept during the entire polishing process by the temperature controller 52.

Figure 3:
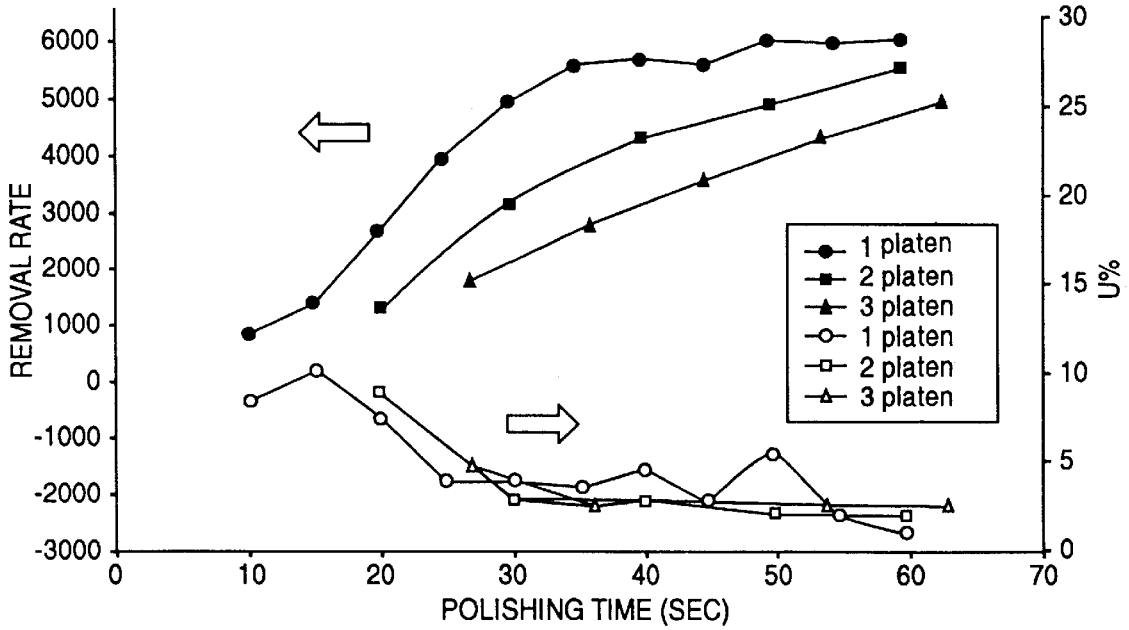
FIG. 3 is a graph illustrating the effectiveness of the present invention method and apparatus in achieving improved polishing uniformity and polishing rate control.

The present invention provides the benefit that the problem of low polishing rates on the wafer edge due to the low temperature of the dispensed slurry is avoided. The overall polishing rate on the wafer surface is therefore enhanced which results in improved uniformity of polishing across the wafer surface. This is shown in FIG. 3 wherein data on removal rates versus polishing time is plotted in solid symbols, while the percent polishing uniformity is plotted in hollow symbols. It is seen that a predictable, increasing trend of removal rate can be obtained by the present invention novel method and apparatus, with the polishing uniformity greatly improved to less than 3%. The present invention novel method and apparatus further enables a change in thickness profile on the wafer edge for a special purpose such that a custom polishing profile can be obtained in a specific application.

The present invention novel method and apparatus have therefore been amply described in the above descriptions and in the appended drawings of FIGS. 2 and 3.

While the present invention has been described in an illustrative manner, it should be understood that the terminology used is intended to be in a nature of words of description rather than of limitation.

Furthermore, while the present invention has been described in terms of a preferred embodiment, it is to be appreciated that those skilled in the art will readily apply these teachings to other possible variations of the inventions.

The embodiment of the invention in which an exclusive property or privilege is claimed are defined as follows:

What is claimed is:

1. A method for controlling slurry temperature in a polishing process comprising the steps of:

dispensing a first volume of slurry from a slurry reservoir onto a polishing pad, rotating the polishing pad while intimately engaging against a polishing head, detecting a first temperature of said first volume of slurry, detecting a second temperature of said polishing pad and comparing said first temperature to said second temperature in a process controller, heating a second volume of slurry kept at said first temperature from said slurry reservoir to said second temperature of said polishing pad, and dispensing said second volume of slurry heated to said second temperature onto said polishing pad.

2. A method for controlling slurry temperature in a polishing process according to claim 1, wherein said polishing process is a chemical mechanical polishing process.

3. A method for controlling slurry temperature in a polishing process according to claim 1, wherein said first temperature is between about 20° C. and about 30° C. while said second temperature is lower than 50° C.

4. A method for controlling slurry temperature in a polishing process according to claim 1, wherein said slurry comprises $SiO_2$ particles.

5. A method for controlling slurry temperature in a polishing process according to claim 1 further comprising the step of comparing said first temperature to said second temperature in a process controller.

6. A method for controlling slurry temperature in a polishing process according to claim 1, wherein said second volume of slurry is dispensed from said slurry reservoir.

7. A method for controlling slurry temperature in a polishing process according to claim 1, wherein said polishing head carries a semiconductor wafer having a top surface to be polished in intimate engagement with said polishing pad.

8. A method for controlling slurry temperature in a polishing process according to claim 1 further comprising the step of heating said second volume of slurry in a conduit by a heater mounted on said conduit.

9. A method for controlling slurry temperature in a polishing process according to claim 1 further comprising the step of heating said second volume of slurry in a slurry transport pipe by a heat exchanger mounted on said pipe.

10. A method for controlling slurry temperature in a polishing process according to claim 1, wherein said heated second volume of slurry when dispensed onto said polishing pad improves polishing uniformity on a wafer surface.

11. A method for chemical mechanical polishing a substrate comprising the steps of:

mounting a substrate on a polishing head exposing a surface to be polished, engaging said surface to be polished with a surface of a polishing pad forming an interface, said surface to be polished and said polishing pad rotating in opposite directions, dispensing a first volume of slurry at said interface, said first volume of slurry being transported from a slurry reservoir and being kept at a first temperature, detecting a second temperature of said polishing pad and comparing to said first temperature, heating a second volume of slurry from said first temperature to substantially said second temperature, and dispensing said second volume of slurry at said second temperature to said interface.

12. A method for chemical mechanical polishing a substrate according to claim 11, wherein said first temperature is under 30° C. and said second temperature is over 30° C.

13. A method for chemical mechanical polishing a substrate according to claim 1 further comprising the step of determining a temperature difference between said first and said second temperature in a controller.

14. A method for chemical mechanical polishing a substrate according to claim 11 further comprising the step of heating said second volume of slurry in a conduit for transporting said second volume of slurry by a heater mounted on said conduit.

15. A method for chemical mechanical polishing a substrate according to claim 11 further comprising the step of mounting a silicon wafer on said polishing head exposing a top surface to be polished.

16. An apparatus for slurry temperature control in a polishing machine comprising:

a polishing disc equipped with a polishing pad on a top surface and a temperature sensor embedded juxtaposed to said top surface for detecting a second temperature, a polishing head for holding a substrate to be polished therein with a top surface of the substrate exposed, motor means for rotating said polishing disc and said polishing head in opposite directions, a slurry dispensing nozzle for dispensing a first volume of slurry on said polishing pad, said nozzle equipped with a first temperature sensor for sensing a first temperature of said first volume of slurry, a controller for comparing said first temperature to said second temperature, and a heater for heating a second volume of slurry from said first temperature to said second temperature for dispensing on said top surface of the substrate through said slurry dispensing nozzle.

17. An apparatus for slurry temperature control in a polishing machine according to claim 16, wherein said polishing machine is a chemical mechanical polishing machine.

18. An apparatus for slurry temperature control in a polishing machine according to claim 16 further comprising slurry reservoir means for storing said second volume of slurry.

19. An apparatus for slurry temperature control in a polishing machine according to claim 16, wherein said first temperature is less than 30° C. and said second temperature is more than 30° C.

20. An apparatus for slurry temperature control in a polishing machine according to claim 16, wherein said substrate is a silicon wafer.

* * * * *